United States Patent [19]

Fayerman et al.

[11] Patent Number: 4,502,720

[45] Date of Patent: Mar. 5, 1985

[54] DOOR LATCH APPARATUS

[75] Inventors: Peter Fayerman, Douglassville; Elwood Shaffer, Reading, all of Pa.

[73] Assignee: Baldwin Hardware Manufacturing Corporation, Reading, Pa.

[21] Appl. No.: 385,325

[22] Filed: Jun. 4, 1982

[51] Int. Cl.[3] ..... E05B 3/00; E05B 15/02

[52] U.S. Cl. ..... 292/348; 70/452; 70/DIG. 57; 292/169.16; 292/357; 292/359

[58] Field of Search ..... 292/21, 92, 169–169.23, 292/165, 336.3, 337, 347, 348, 350, 351, 357–359, DIG. 53, DIG. 66; 49/1, 7, 8; 70/DIG. 57, 448, 449, 452

[56] References Cited

U.S. PATENT DOCUMENTS

| | | | |
|---|---|---|---|
| Re. 30,263 | 4/1980 | Horvath | 292/341.16 |
| 877,374 | 1/1908 | Rickli | 49/7 |
| 951,836 | 3/1910 | Noack | 292/350 |
| 1,164,016 | 12/1915 | Reutter | 70/149 |
| 1,164,017 | 12/1915 | Reutter | 70/149 |
| 1,769,314 | 7/1930 | Rymer | 70/149 |
| 1,835,946 | 12/1931 | Jewell | 70/149 |
| 2,125,518 | 8/1938 | Oldham | 292/359 |
| 2,250,787 | 7/1941 | Anderson | 85/32 |
| 2,529,230 | 11/1950 | Smith et al. | 70/149 |
| 2,602,318 | 7/1952 | Belausteguigoitia | 292/359 X |
| 2,668,319 | 2/1954 | Keys | 70/452 X |
| 2,677,263 | 5/1954 | Smith | 70/149 |
| 2,827,323 | 3/1958 | Kessel et al. | 292/352 |
| 3,024,055 | 3/1962 | Novarino | 292/169 |
| 3,237,976 | 3/1966 | Campoli | 292/350 X |
| 3,325,941 | 6/1967 | Prucha | 49/7 |
| 3,881,331 | 5/1975 | Tranberg et al. | 70/107 |
| 3,896,644 | 7/1975 | Nagy et al. | 70/149 |
| 3,939,680 | 2/1976 | Heidkamp | 70/452 |
| 3,990,277 | 11/1976 | Mullich | 70/107 |
| 4,007,954 | 2/1977 | Erickson | 292/165 |
| 4,042,268 | 8/1977 | Colgan | 292/347 |
| 4,055,361 | 10/1977 | Moses | 292/359 |
| 4,065,164 | 12/1977 | Bartels | 292/347 |
| 4,161,804 | 7/1979 | D'Hooge et al. | 16/48.5 |
| 4,195,819 | 4/1980 | Chastanier | 254/186 R |
| 4,243,256 | 1/1981 | Frydrych | 292/245 |

FOREIGN PATENT DOCUMENTS

| | | | |
|---|---|---|---|
| 258757 | 12/1967 | Fed. Rep. of Germany | 70/452 |
| 398165 | 8/1933 | United Kingdom | 292/348 |

*Primary Examiner*—Gary L. Smith
*Assistant Examiner*—Russell W. Illich
*Attorney, Agent, or Firm*—Steele, Gould & Fried

[57] ABSTRACT

A door latch mechanism for controllably securing a door, the latch mechanism of the type having a spindle and operating handles, comprises a fusible connecting member rigidly attaching the handle and spindle at room temperature, the fusible connecting member melting at elevated temperatures to permit relative rotation of the handle and spindle. The handle is mounted using a connecting member which is attached to the latch trim using a screwless connection. It is particularly applicable to latches using lever handles in that a positive positioning mechanism holds the handles at their selected positions, regardless of wear and age.

8 Claims, 9 Drawing Figures

DOOR LATCH APPARATUS

BACKGROUND OF THE INVENTION

1. Field of the Invention

This invention relates to the field of door latches, locks and closure apparatus, and in particular to a lever handle lock which becomes temporarily inoperative when exposed to fire.

2. Description of Prior Art

Various designs for doorknobs, handles and such actuators are known in the art. Although globe shaped doorknobs are the most common, various other door latch actuators are known for various purposes. For example, doors which must be opened by persons carrying items are sometimes equipped with lever handles which may be actuated by a person using his or her elbow. Freezer doors and the like are commonly equipped with closures having a mechanism which need only be pushed to open the door from the inside, and include latched levers on the outside.

The present invention concerns door handles of the type which are rotated to open the door, and is particularly adapted for use with lever handles. Horizontally-aligned rotatable lever handles are easily actuated by handicapped persons, by persons carrying various items, and are also convenient for the public at large. Accordingly, horizontally-aligned rotatable lever handles are very useful for hospital doors and the like, and could be advantageously applied to doors in general.

Locks and latches on doors frequently comprise a shaft or spindle member which extends completely through the door near the non-hinged edge of the door, connecting door handles on opposite sides of the door. The spindle is rotated using a knob or lever handle, and a spring-loaded latch bolt is thereby drawn back into the body of the door, or released to mate with a strike mounted in the door jamb. Beyond these simple functions,.the closure can be adapted to a number of needs.

The usual external door on a structure (i.e., an "entryway") comprises a lock which can be set to prevent the latch from being actuated by a person outside the structure. The lock permits the closure to be released by a person inside the structure. A person outside the structure can be said to be on the "key side" and a person inside the structure can be said to be on the "non-key side" in the usual situation. Of course, there are also situations where the key side is the interior of the structure, or both sides require keys for one reason or another. For example, where a door comprises a window, easily broken by a burglar, a key may be required on the inside as well, using a "double cylinder" lock. In any event, the closure includes at least a handle and a spindle.

Another possibility concerns the usual door between interior rooms of a structure. There is usually no need to restrict access from either side, and therefore the latch is made operable merely by turning the knob, lever handle or the like on either side of the door. It will be appreciated that the mechanical structure of such a latch mechanism requires substantially fewer parts than that of an external door.

Yet another possibility concerns a door bounding an interior room where an occupant may desire privacy, however, there is little threat of an intruder that might use force or physically damage the latch in an effort to open it. In these situations, a lightweight turnpiece would be employed to controllably prevent the latch from being actuated.

All the foregoing situations may advantageously employ a lever handle actuation system. The present invention applies to each situation and includes a fusible link between the lever handle and spindle which disengages the connection between the handle and spindle in the event of fire. Depending on security requirements, the trim and mounting hardware for the lever handles are preferably made screwless, that is, the can be hidden such that the mechanism is free of exposed attachment means on the key side. A novel latch operating mechanism is adapted for use with a lever handle as opposed to a knob, the lever handle being more mechanically demanding than a knob because a lever is inherently non-symmetrically weighted, or "cantilevered".

The general use of fusible links to allow doors to close of their own weight or by the force of springs, to prevent actuation of a latch, and to enable actuation of a latch nonwithstanding a lock, are all known in the art. The particular structures and functions of such fusible link mechanisms vary widely.

U.S. Pat. No. 4,007,954–Erickson discloses a hospital latch employing a fusible link to prevent actuation of a latch in the event of a fire. The device employs a fusible pin for holding a latch bolt stop lever above a position from which it will otherwise drop to foul the latch mechanism. The fusible pin melts in a fire; the latch bolt stop lever falls to foul the latch mechanism; and, theoretically, persons are prevented from blundering into the area of the fire in an effort to escape. Moreover, the now-locked door will not accidentally open due to falling debris and the like.

Inasmuch as Erickson's latch bolt stop operates by fouling the latch mechanism when the fusible pin melts, the latch mechanism must be disassembled and the fusible device replaced in order to re-activate the latch mechanism after a fire. It will be appreciated that when such a mechanism is applied to a hospital door, the effect is to lock the door both during and after a fire, until the latch can be disassembled and repaired. Persons who might use the door may become casualties unnecessarily, for example, if a fireman arrives to put out a fire in the hallway. The fireman might have led the occupants to safety had the latch been still operative or easily made operative.

An opposite approach is taken by devices such as that of Horvath, U.S. Pat. No. 4,015,869 (re-issue patent Re. 30,263). Horvath teaches a catch mechanism for a latch (i.e., a strike plate) which is rendered completely inoperative upon melting of a fusible member. The catch opens when the fusible link melts, releasing the door. The interaction of the latch and catch mechanism normally holds the locked door closed. Accordingly, disabling the catch mechanism is equivalent to unlocking the door, and allows occupants an escape path through a door which would otherwise be locked.

The rationale of Horvath and the like, namely unlocking and releasing doors in the event of fire, is sometimes employed to close doors, for example to confine and to starve a fire of oxygen. Many buildings, and in particular public buildings such as schools, have heavy fire doors placed at various positions in the hallways, the fire doors dividing rooms from hallways and the like. Such fire doors may be held open using a fusible member, and when a fire melts the fusible member, the fire door falls shut to confine the fire. Examples of such fusible members are U.S. Pat. Nos. 4,161,804—D'-

Hooge et al, 3,325,941—Prucha, and others. The same rationale can be employed with windows, such as disclosed in U.S. Pat. Nos. 2,250,787—Anderson and 4,195,819—Chastanier. Chastanier employs a fusible link in an axial connection between a winched pulley and a brake. Under influence of heat, the axial connection melts, and the pulley is released to allow a window to close.

The present invention employs a fusible link to break an axial connection between a door lever handle and the spindle which actuates the latch. The fusible axial connection is disposed between the lever handle and spindle, rather than centrally in the lock. In this manner, lever handles fusibly connected on both sides of the door can be employed not only for safety, but also to provide an indication of conditions on the opposite side of the door. A fire on a first side of a door will melt the fusible link at a given temperature. Dissipation of heat and losses in conduction from one side of the door to the other will delay melting of the fusible link on the opposite side which occurs after a certain time. Therefore, a fire in a room will eventually cause the lever handle on the opposite side of the door, namely in the hallway, to fall downward, indicating a possible danger to a person opening the door.

Firemen are often injured by explosions when a door enclosing a burning room is suddenly opened. The increase in oxygen available to the fire when a door is opened results in a sudden increase in combustion, and an accompanying blast of heat and flame. Particularly with prior art lever handles, such an explosion can be caused by a jet of water from a fire hose striking the lever handle and actuating the latch. With the present invention, a firemen will be aware of the fact that the fusible link has previously broken, because the lever handle will point downwardly rather than horizontally.

Should a jet of water be briefly directed against a lever handle while the fusible link is melted, the lever handle will rotate without actuating the latch mechanism. A substantial application of water will cool and re-harden the fusible member and re-attach the lever handle to the door. Therefore, should the fireman so desire, the door can be opened, even though the fusible link was melted. Additionally, a fire present on the hallway side of the door will create the same effect on a lever handle. However, a person inside the room will have an opportunity of attempting an escape by actuating the level handle inside before its fusible link melts.

Lever handles are desirable over doorknobs because they are more easily actuated, for example by handicapped persons and persons carrying items of various descriptions. Lever handles place an unusual strain on a latch or lock mechanism, however, because they are cantilevered and their weight and "moment arm" must be opposed by the latch mechanism. The longer the handle, the greater the moment arm and the greater the strain on the latch mechanism. In the prior art, no specific provisions were made to accommodate lever handles on latches or locks. Rather, the same latches and locks which were used with doorknobs were merely equipped with lever handles. The strain of the lever handles required that a heavy duty latch/lock mechanism be employed, or that the lever handles be relatively light or counterweighted. Spring mechanisms were employed to hold a lever handle in a desired position. Reference may be made to U.S. Pat. No. 1,769,314—Rymer, disclosing a spring member adapted to resist rotation of a lever handle from a fixed "home" position. In order to ensure the Rymer's lever handle remains attractively horizontal as it is initially mounted, a heavy duty spring and latch mechanism are required, or the lever handle must be made light in weight. Even if these precautions are taken, with use and wear, the weight of the lever handle will operate against the spring to cause the "home" position of the lever handle to droop lower and lower. Maintaining an exact horizontal handle is difficult because the handle is generally attached to the squared spindle shaft via a set screw, whereby the handle will be mountable only at one of four angles unless special provision is made for a continuously variable, lockable position, for example, a set screw and cylindrical shaft arrangement.

The prior art teaches initially setting lever handles at a home position somewhat above the home position which would be maintained by the spring without the weight of the lever handle. When the lever handle is installed, the weight theoretically offsets the placement of the 37 home" position above horizontal, and as a result the lever handle rests at exactly horizontal. An offset of seven degrees is typical. Unfortunately, this practice does not account for wear and fatigue in the spring. Of course, a latch having a very strong and heavy duty spring can be designed such that the effects of wear and metal fatigue on the spring will be unnoticed. Such a latch would be unacceptably difficult to operate especially for handicapped persons or persons with their hands full.

The present invention provides a positive stop for one or both lever handles. A hub member mounted to the spindle has a fixed rigid extension which is forced against a pin, rigidly mounted to the casing, by means of a spring. The alignment of the lever handle is therefore exactly set to a home position which does not change with wear and age. The alignment of the spindle being set, the lever handle need not be adjustable or continuously positionable.

The prior art has conceived of dead bolt locks having both the latch mechanism and the dead bolt mechanism as part of the same unit. In many such devices, it is necessary to unlock the lock mechanism in order to operate the latch mechanism even from the non-key side. In order to avoid such a requirement, lock manufacturers have on occasion designed locks which are operable from the non-key side, without regard to the fact that the key side is locked. Often a push button selection on the face of the lock is provided in order to select between operating modes for the latch and/or lock. The present invention employs inside and outside lever handles mounted on co-axial spindles which are threadably rather than rigidly connected, enabling relative independent rotational movement. Operating the lever handle on the non-key side retracts the deadbolt and latchbolt mechanisms simultaneously.

The present invention employs positively positioned, fusibly attached lever handles on a novel lock/latch mechanism which further comprises a screwless mounting, for the ultimate in security and convenience without loss of attractiveness and safety.

SUMMARY OF THE INVENTION

It is an object of this invention to protect both occupants and firemen from accidental exposures to fires on the opposite side of a door.

It is also an object of this invention to facilitate the use of lever handle latches and locks.

It is also an object of the invention to provide a lock mechanism capable of carrying heavy solid metal lever handles, aligned horizontally.

It is another object of this invention to improve the attractiveness of lever handle locks by positively positioning the lever handles.

It is another object of the invention to maximize security and convenience in a lock and latch mechanism which is attractive and safe.

It is yet another object of the invention to conceal and make inaccessible the means by which a lock is mounted.

It is yet another object to ensure the life and safety of an individual by permitting him the opportunity to attempt an escape from a fire.

These and other objects are accomplished by a door latch mechanism for controllably securing a door, the latch mechanism of the type having a spindle and operating handles, comprising a fusible connecting member rigidly attaching the handle and spindle at room temperature, the fusible connecting member melting at an elevated temperature to permit relative rotation of the handle and spindle. The fusible connection is achieved using a connecting member which is mounted to the latch trim using a concealed and/or protected connection. The invention is particularly applicable to latches using lever handles in that a positive positioning mechanism holds the handles at their selected positions, regardless of wear and age.

BRIEF DESCRIPTION OF THE DRAWINGS

There are shown in the drawings the embodiments which are presently preferred. It should be understood, however, that the invention is not limited to the precise arrangements and instrumentalities shown.

DETAILED DESCRIPTION OF THE PREFERRED EMBODIMENTS

This invention concerns latches and locks operable by lever handles, and locks in general having fusible connections therein. Given these features and the general objective of maximizing security in a lock mechanism, the present invention seeks to provide safety and convenience in a secure and attractive latch and lock mechanism.

Figure 1:
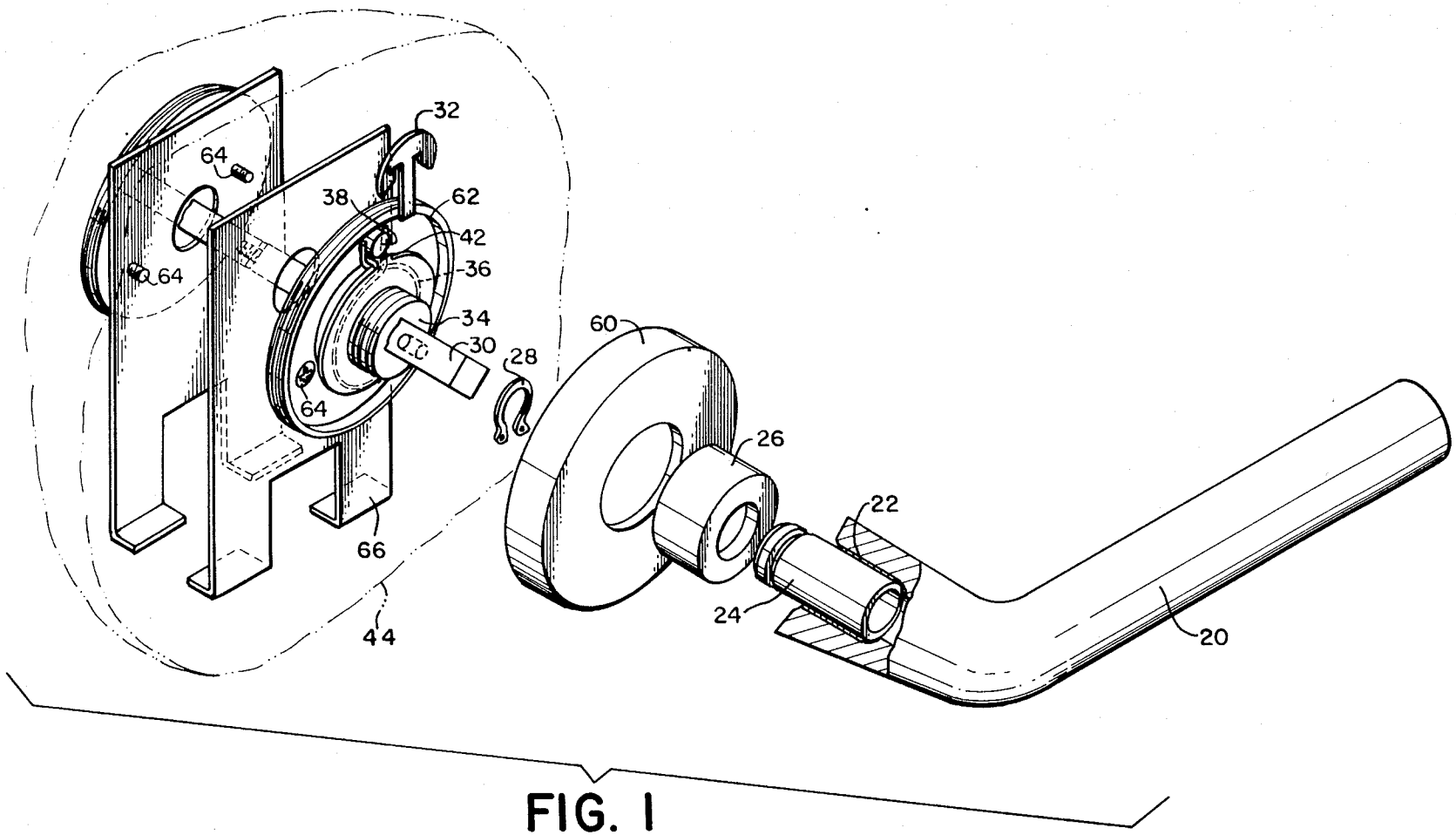
FIG. 1 is an exploded view, in perspective, of lever handle, mount and spindle according to this invention, the door shown in dash-dot lines.

As shown in FIG. 1, the invention relates basically to a lever handle 20, adapted to operate a latch and/or lock mechanism to open or close door 44 (shown in dash-dot lines), by means of rotatable shaft or spindle 30. Spindle 30 is non-circular in cross-section, for example having a square cross-section, whereby additional apparatus such as a latch bolt (not shown) may be actuated. The usual latch comprises a bolt member which is spring-biased to normally extend from the edge of a door, where it interacts with a strike and catch mechanism when the door is closed. A user withdraws the latch bolt from the catch mechanism, drawing the latch bolt back into the door body, by rotating handle 20 and spindle 30. The door is then free to be opened. A lever handle 20 is shown in the drawings as the preferred handle mechanism. It will be appreciated, however, that the invention is also applicable to symmetrically-weighted handle members, such as knobs, vertically-directed handles, and the like.

Handle member 20 is preferably of solid metal, because it is expected to encounter rough treatment at times. Use of a solid metal handle avoids problems with excessive wear and gives an impression of quality and security, but causes a relatively large weight which, due to the non-symmetrical shape of the handle, results in a force tending to rotate shaft or spindle 30. The force is due to gravity on horizontally-directed handle 20. The longer the handle, the greater the moment arm, and the greater the force on the spindle.

FIG. 1 shows one means of holding handle 20 in a horizontal or other desired position. One or more trim hubs 34 are disposed on the spindle, and movably secured at a certain angle with respect to the door by means of spring 36 which rests against pin 38, resisting any rotation of spindle 30, either clockwise or counterclockwise, from a "home" position. Pin 38 is rigidly mounted to the door by means of trim mounting plate 62, attached to the door body by screws 64. The entire construction including plate 62 with attached pin 38, spring 36 and trim hub 34 is covered by means of trim plate 60, threadably attachable to trim mounting plate 62.

Spring 36 is a generally circular loop of resilient wire which would straighten if freed, and may be wrapped around trim hub 34 one time, or as many times as required for the stiffness desired. Both ends of the loop extend upwardly to rest against either side of pin 38, urged against opposite sides of pin 38 by the resilience of the spring. Trim hub 34 comprises a rearwardly extending tab 42 which fits between the ends of spring 36, immediately below pin 38. As spindle 30 is rotated in either a clockwise or counterclockwise direction, the tab 42 on trim hub 34 carries one or the other of the ends of spring 36 away from pin 38, the other end resting against the pin, the spindle turning against the force of the spring.

Although only one handle 20 is shown in FIG. 1, the invention preferably comprises a trim hub/spring/pin mechanism for a lever handle on both sides of the door. Spindle 30 is preferably formed in two parts, threadably connected at the center, whereby the handles on opposite sides of the door can be ascribed different and independent functions because each of the spindles, although co-axial with the other, may be rotated independently. The axial position of spindle 30 is set relative to the trim hub 34 and therefore the door by means of pin 32, placed through a transverse hole in the spindle, and tending to block axial movement of the spindle in a direction toward the trim hub. A pin 32 could be used on both sides of the latch if the spindle members were not threaded to the same shaft, as preferred, or is some clearance for axial movement was allowed.

The threaded portion of trim hub 34 is adapted to mate with threaded trim bushing 26, attached to handle 20 but rotatable with respect to handle 20. An additional threaded portion is provided on the outer circumference of trim mounting plate 62, for attaching trim plate 60 which has a mating thread on its inner circumference. Trim plate 60 covers and conceals the inner structure, making it appear screwless. An alternative embodiment in which all screws on one side of the door are completely inaccessible is described hereinafter.

As trim plate 60 covers screws 64, the means of mounting the latch/lock mechanism is not visible when the latch mechanism is assembled. The attachment between the lever handle 20 and spindle 30 is concealed and requires no set screw. Lever handle 20 is rigidly attached to barrel shaped connecting member or bushing 24, having an annular groove around its circumference into which retaining ring 28 fits to interlock handle 20 and threaded bushing 26. Grooved connecting member 24 is first placed through the unthreaded hole in bushing 26, said hole being closely dimensioned to connecting member 24, and attached by forcing retaining ring 28 into the groove of extension 24. Since retaining ring 28 is somewhat larger than the hole in threaded bushing 26, handle 20 may be rotated relative to bushing 26, but may not be axially withdrawn. Bushing 26 is internally threaded and is thereby attached to trim hub 34, and tightened by means of a spanner wrench placed in a transverse bore on bushing 26 (not shown).

FIG. 1 also shows internal plates 66 within a hollow in the body of door 44. Plates 66 are attached to trim mounting plates 62 by means of screws 64, and due to flanges at their lower edge, can assist in support of a latch or lock mechanism within door 44. It will be appreciated that various latch and lock mechanisms could be mounted within the door, as required in the particular location. For example, an entryway lock requiring a key on one or both sides could be actuated by spindle 30 and keys or lock levers, as required. For internal structural doors where access is to be limited but security requirements are minimal, a lightweight lock mechanism could be carried. Such as installation might be used for a bathroom or the like. If no security function is intended, a simple latch bolt, withdrawn upon rotation of handle 20 from either side, could be carried within door 44.

Whichever type of security mechanism is desired, the present invention improves the safety of the mechanism in the event of fire. Lever handle 20 and grooved connecting member 24 are connected together by means of fusible link 22. Fusible link 22 comprises a low temperature silver solder which melts at approximately 430° F. (220° C.). A suitable composition comprises 96.5% tin and 3.5% silver. Connection member 24 is bored axially to match the cross-section of spindle 30, for example square in cross-section, over which connection member 24 is slideably disposed. Accordingly, member 24 and spindle 30 are interlocked against relative rotation.

The axial bore or "broach" may be formed, as known in the art, by forming a cylindrical bore along the axis of connection member 24, then cutting clearance slots for the corners of the square spindle. When a fire in the vicinity of the door raises the temperature of handle 20 to the melting point of fusible link 22, the axial connection between handle 20 and spindle 30 is broken. When this occurs, handle 20 will drop from the horizontal position shown in FIG. 1 to a vertical position, due to the force of gravity.

Persons who may be within the room at the time the same catches fire will not be prejudiced by the latch/lock mechanism becoming disabled when fusible link 22 is broken. The melting temperature of fusible link 22, e.g., 400° F. (204° C.), is sufficiently high that no survivors can be expected to remain within the area at the time the fusible link gives way. Should survivors remain, they must stay clear of such heat in order to survive further, or escape quickly.

Should a fire occur on the opposite side of the door from handle 20, if a similarly connected lever handle is provided on that side of the door it will drop due to the melting of its fusible link. Whether or not the opposite side has a lever handle, after a period of time, for example 20 minutes, the heat on the opposite side of the door will be conducted through the lock mechanism, especially along spindle 30, and will melt the fusible link in handle 20, opposite the side where the fire is actually located. Fusible link 22 when used with a lever handle therefore provides a valuable visual indication of the temperature on the opposite side of a door. A fireman who is dispatched to a fire scene will be automatically advised that high temperature conditions either exist or formerly existed behind any door which, unlike other doors, has a vertically-directed lever handle. The present condition of the fusible link in handle 20 can be ascertained by attempting to open the latch, or merely by checking the temperature of the handle. This must of course be done with great care.

In addition to the aforesaid visual indication, fusible link 22 prevents accidental opening of the latch mechanism while a fire is in progress. Debris falling from the ceiling, jets of water from firemen's hoses and the like cannot accidentally open the latch by acting against lever handle 20. Should a fire be burning behind a door, a sudden increase in oxygen when the door is opened can cause a catastrophic explosion. Once fusible link 22 has melted, debris falling on lever handle 20 will not strike the handle in its horizontal position, and moreover, in whatever way handle 20 is struck, it will rotate freely with respect to spindle 30, and will not open the latch.

Should a fireman or other person be placed in the position that the only route of escape is through a door having a melted fusible link, the fusible link can be re-attached and the handle re-activated by cooling the door or engaging the spindle with pliers or the like. A jet of water from a hose can be deliberately played on the latch mechanism, whereby handle 20 will be again rigidly connected to spindle 30. The maximum width of the fusible line is about 0.008 inches, in order to take advantage of capillary action and surface wetting. Even if some of the solder has dripped out, enough will remain to enable reconnection. Door 44 can then be opened, preferably very slowly and with great care, the trapped fireman escaping, albeit to an uncertain fate due to the high temperature that first melted the fusible link. The fusible connection is shown in more detail in FIGS. 7 and 8. With reference to FIG. 8, connection member or handle extension 24 and spindle 30 are locked against relative rotation by the interfitting of spindle 30, having a square outer surface in cross-section, and the bore in extension 24, cut to like dimensions. Use of a square spindle and square cut, slidable attachments thereto is standard in the industry. A fusible link need only be located somewhere between handle 20 and spindle 30. It will be appreciated that the entire extension 24 could be formed of fusible material, as could handle 20 or spindle 30. In order to provide a fusible link which automatically re-activates the latch mechanism when the same is cooled, it is preferred that the fusible link comprise a relatively thin connection between rigid components rather than a larger fusible member which will deform and flow out of operative position when melted. Inasmuch as the layer of fusible material is sufficiently thin to be held in place by surface wetting and capillary action (e.g., 0.005 inches thick), melting does not prevent the handle from operating permanently.

Figure 7:
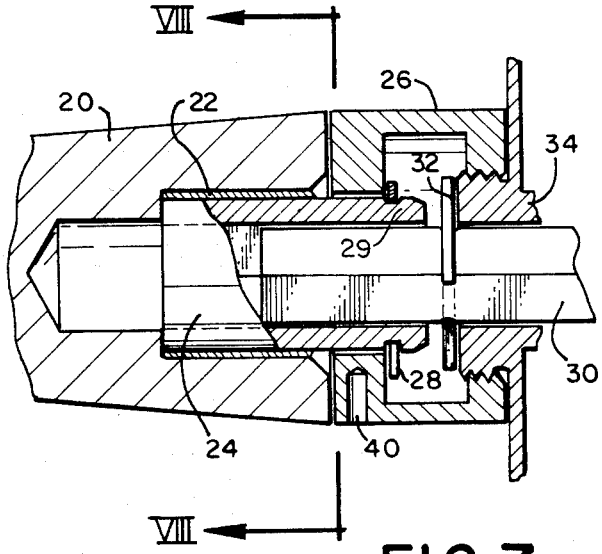
FIG. 7 is a detail view of the mounting of the lever handles, as shown in FIG. 6.
Figure 8:
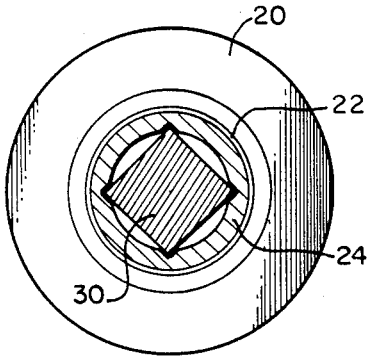
FIG. 8 is a section view taken along lines VIII—VIII in FIG. 7.

As shown in FIG. 7, extension 24 comprises an enlargement 29 disposed behind threaded bushing 26, where it is axially locked but rotatable with respect to bushing 26 by means of retaining ring 28. Ring 28 is dimensioned to settle into the slot in extension 24, and when so settled is nevertheless larger than the bore in bushing 26, preventing axial displacement of handle 20 and bushing 26. When bushing 26 is threaded to trim hub 34, handle 20 is axially and rotationally attached to the trim hub and held in position.

Figure 2:
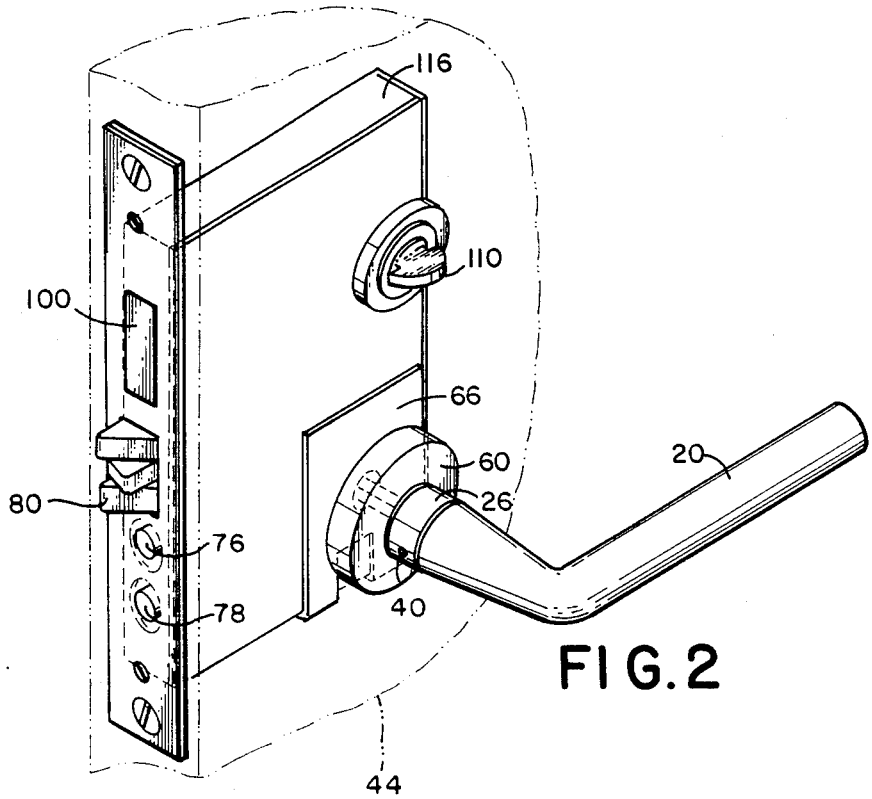
FIG. 2 is a perspective view of a preferred embodiment of the invention, adapted for an entryway lock.
Figure 4:
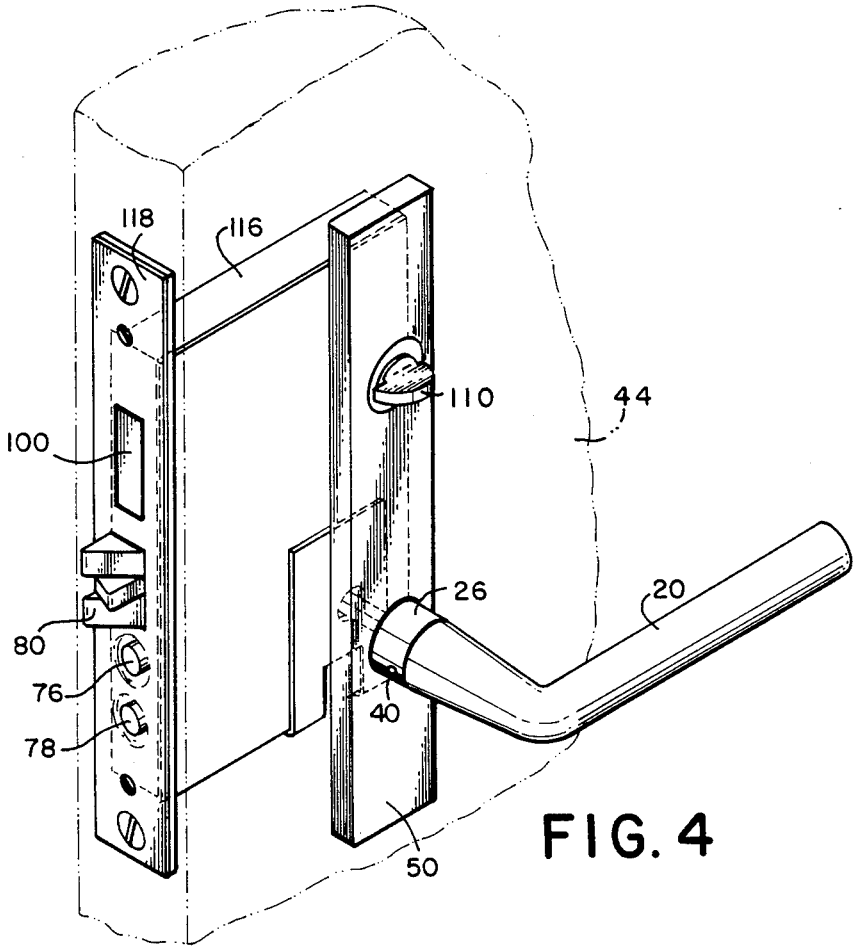
FIG. 4 is a perspective view of an alternative embodiment of the invention, adapted for an entryway lock.
Figure 5:
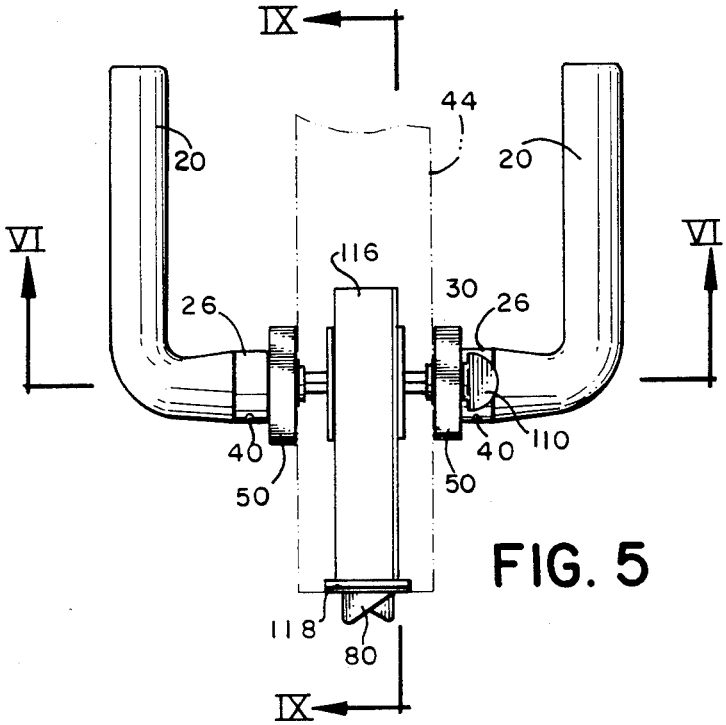
FIG. 5 is a top plan view of the lock of FIG. 4.

With reference to FIGS. 2 and 4, the present invention is advantageously embodied in entryway latch-/lock mechanisms. Although such mechanisms can be embodied with various security features including double lock cylinders and the like, the invention will be discussed in terms of a single cylinder lock having a lock-operating handle on the non-key side of the door. Latch/lock casing 116 carries a dead bolt 100 and latch bolt 80. When the door is locked, for example by means of lever 110, dead bolt 100 is extended into a catch mechanism in the door jamb. Whether or not the door is locked, latch bolt 80 normally engages the catch mechanism in the door jamb, preventing the door from freely swinging open and closed. Latch bolt 80 includes an anti-friction mechanism, specifically a member pivotally attached to the case and adapted to force the latch bolt back when the door closes, as known in the art. Mode selector push buttons 76, 78 allow the user to select the manner in which the lock will function, for example, locking by means of the latch bolt only, or locking by means of the dead bolt.

As shown by a comparison of the embodiments of FIGS. 2 and 4, one or more trim plates can be employed on the surface of the door. FIG. 2, which illustrates the embodiment of FIG. 1, is not entirely screwless in that trim plate 60 can be removed by unthreading the same from trim mounting plate 62, providing access to screws 64. The lock could not be opened by merely removing the trim and lever handle, assuming the mechanism had a similar trim and handle on the opposite side, but it is nevertheless preferable to maintain as high a level of security as conveniently possible. Therefore, as shown in FIGS. 4 and 6, a concealed and/or protected attachment is preferred.

In the concealed and/or protected embodiment, a connecting post extends between the trim plates on both sides of the door. As shown in FIG. 6, backer plate 52, screwed from behind to trim plate 50, serves as the rear member for trim hub 34, and carries centering pin 38. This mechanism is entirely constructed and enclosed before trim plates 50 are attached to the door, and the construction is therefore completely inaccessible to attempted burglars. Post 120 locks trim plate 50 to the door, namely, by attaching the two trim plates 50 together on opposite sides of the door. On the key side of the door, no screws whatsoever are accessible. On the non-key side, set screws 122 lock post 120 to the trim plate, namely at a notch formed adjacent the end thereof. Accordingly, the non-key side is not entirely screwless. Nevertheless, the screws are well hidden.

Figure 6:
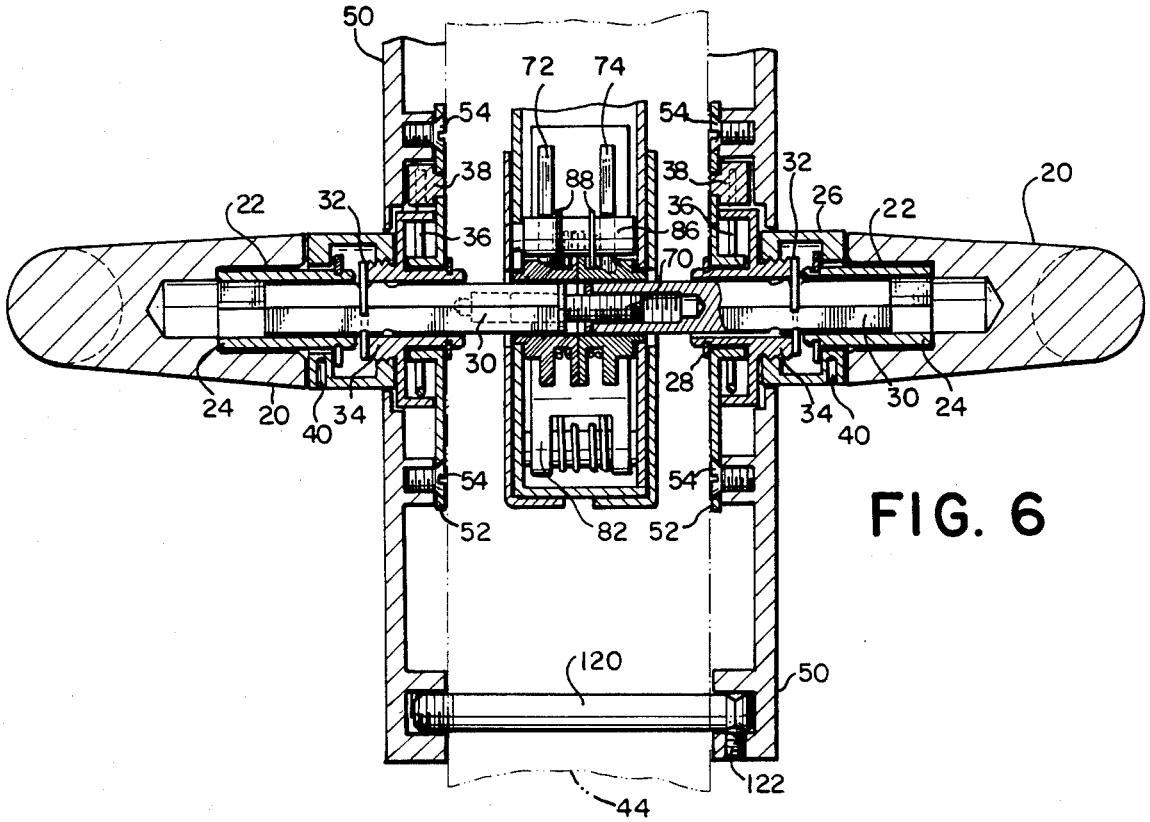
FIG. 6 is a section view taken along lines VI—VI in FIG. 5.

Of course, the embodiment shown in FIGS. 1 and 2 and the embodiments shown in FIGS. 4 and 6 can be combined in some respects if desired. Specifically, an entirely screwless trim plate for the key side could be attached to a trim plate of the type shown in FIG. 1, using an appropriately-positioned post 120, locked either by set screws 122, or by directing screws 64 of FIG. 1 axially into posts 120 which could be bored and threaded.

It has been standard practice in the prior art to initially position the spring mechanism such that the lever handles would be positioned slightly above horizontal under no load (i.e., before the handles are installed). In this manner, when the lever handles are installed, the deformation of the spring under the weight of the handles results in a horizontally-aligned handle on both sides of the door. It will be appreciated that this is a fine adjustment which is difficult to execute under the best of conditions. Moreover, as the apparatus ages and the springs wears, the "zero" positions of the lever handles slowly but surely sag downwardly.

This invention comprises a latch and/or lock operating apparatus in which a lever handle is positively positioned against a stop disposed in the direction of upward rotation of the lever handle. A spring mechanism presses the spindle with attached lever handle against the stop, such that no balancing of springs is required. Unlike prior art devices which wear by the slow sagging and metal fatigue of a spring, the present invention wears by the much smaller deterioration of abutting metal surfaces. Moreover, the deterioration of the abutting surfaces is disposed such that the wear causes the lever handle to be positioned above the original horizontal position, rather than sloppily and lamely sagging downward therefrom.

Figure 3:
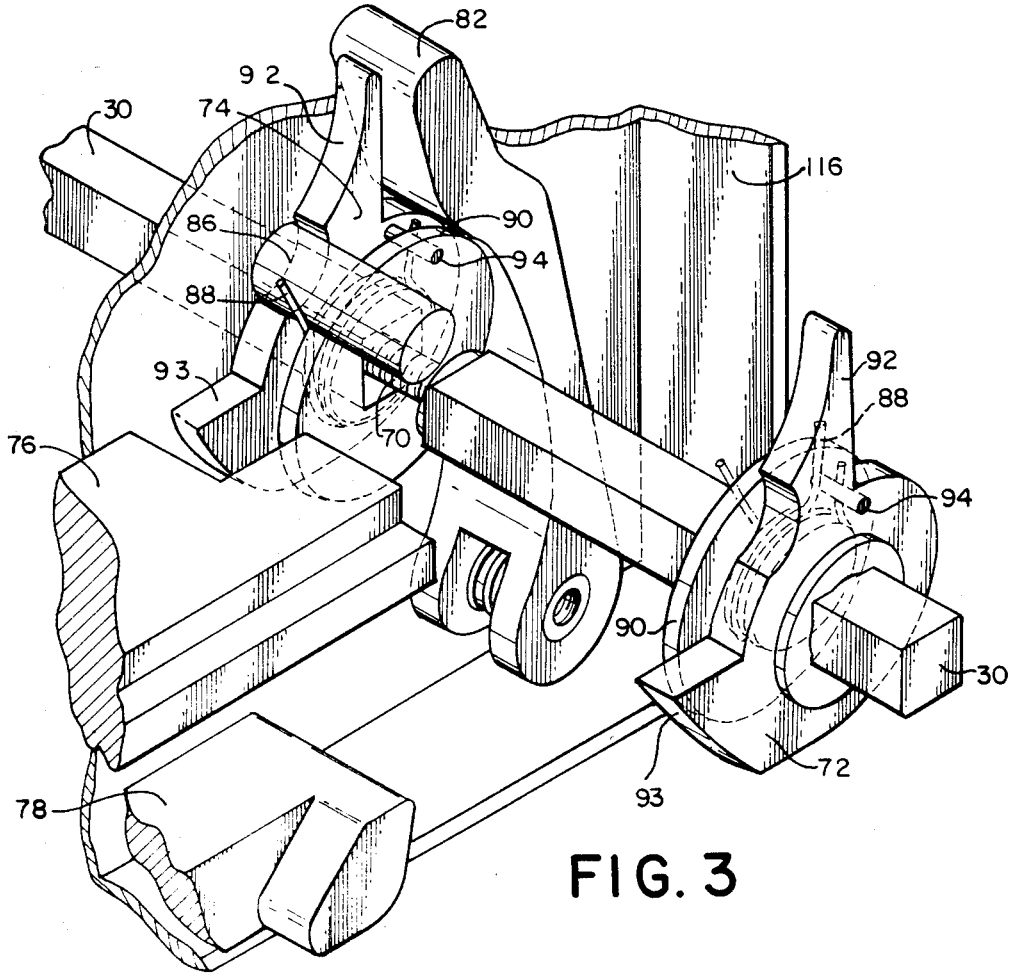
FIG. 3 is a cutaway perspective view in enlarged scale of the positive lever-positioning mechanism of the present invention, shown partially disassembled.
Figure 9:
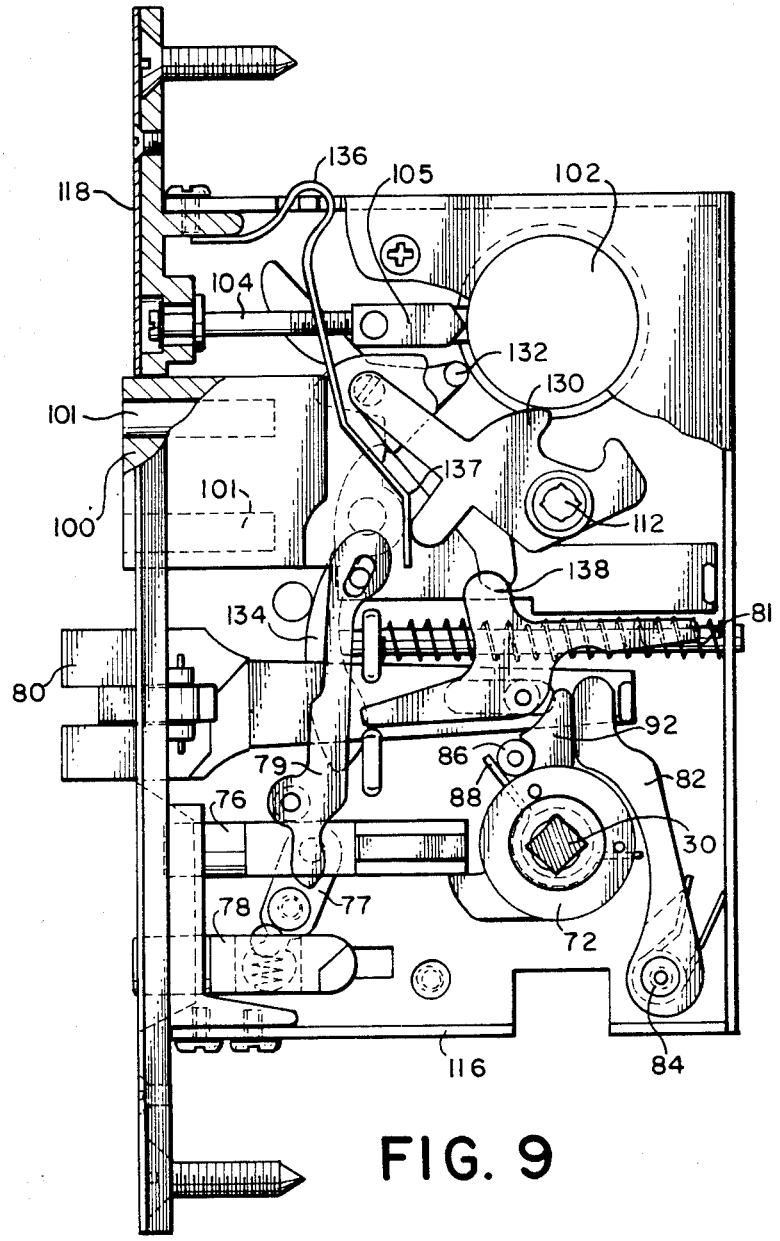
FIG. 9 is a cutaway view of the lock and latch mechanism according to this invention.

The stop apparatus is shown in cross-section in FIG. 6, in enlarged detail in FIG. 3, and used in an entryway lock in FIG. 9. With regard to FIG. 9, hub mechanism 72, mounted on spindle 30 to which the lever handles are attached, positively positions the spindle against pin 86 by means of hub spring 88. The lever handles may be turned only downwardly from their rest position. In so turning the lever handle, spindle 30 is rotated clockwise in FIG. 9, carrying hub extension 92 away from pin 86 against the force of spring 88. Hub extension 92 is pressed between hub lever 82 and pin 86. Hub lever 82 is pivotally mounted on pin 84. The opposite, operative end of hub lever 82 engages the end of latch bolt 80, which may be withdrawn by the latch lever as described, or released to be extended by the action of latch bolt spring 81.

It will be appreciated that in a simple latch requiring no security, a continuous one-piece spindle could be directly attached to handles on both sides of the door, whereby both would move if the latch was operated. For secure installations such as entryway lock 9, separate spindle members may be provided for each side of the door, operating independently. Accordingly, there are two hub members resting against pin 86. FIG. 3 shows a detail of the dual hub arrangement. Spindle 30 is centrally divided into a key side and a non-key side spindle by means of a threaded interconnection. Both spindle members are axially threaded, into which thread is fit a threaded shaft 70. The spindle halves are therefore axially connected but rotatable with respect to one another.

Hub member 72, mounted on one of the two spindles, and hub member 74, mounted on the other spindle, are mirror images of one another. Both comprise hub extension members 92, adapted to stop the rotation of the hubs and spindles against pin 86. Each hub comprises a first plate carrying hub extension 92 and, if desired, an additional hub extension 93, adapted to interact with mode setting push button 76, 78. A circumferential groove is provided between the extension carrying plate and a second plate 90, the groove being bridged by pin 94. Spring 88 is a circular spring having extending ends, one of which ends is placed behind the pin 94, the other of which ends is placed behind stop 86, tending to hold each spindle securely at a position defined by extension 92 and stop pin 86.

With further reference to FIG. 9, the entryway lock of the invention includes a casing 116, preferably covered at the door edge side by a decorative plate 118. A lock cylinder (not shown) is threadably inserted into mounting hole 102, and locked in place by the action of screw 104, operable to press locking member 105 against the lock cylinder. As is known in the art, the lock cylinder comprises a downwardly extending cylinder cam at the rear of the cylinder, which may be rotated using the key.

In order to lock the door, the user on the non-key side employs a lock-operating turn piece placed in mounting hole 112. On the key side, the user turns the key in a like manner to rotate turn-hub 130 around its pivot at mounting hole 112. In this manner the dead bolt is extended into a catch mechanism in the door jamb, locking the door. The dead bolt is squarely shaped to discourage any attempt to urge a tool such as a piece of plastic between the bolt and the door jamb. Dead bolt 100 also comprises sawproof pins 101, 101, of carbon steel or the like.

In unlocking the door, the user may withdraw the dead bolt by rotating turn-hub 130 around pivot 112, using either a turn piece on the non-key side, actuating the lever handle on the non-key side, or the lock cylinder and key from the key side. In addition, from the key side, the latch bolt may be operated as well, by further rotating the lock cylinder such that the cylinder cam thereof contacts cylinder lever 132. Cylinder lever 132 is operatively connected to latch lever 134 such that the latch bolt may be operated using the key as well as the lever handles.

The lock mechanism of FIG. 9 is a balanced bistable apparatus due to the interaction of turn-hub 130, leaf spring 136 and biasing lever 138. Spring 136 is mounted against casing 116 by extending spring 136 through the wall of the casing and back in. In the position shown in FIG. 9 (i.e., "unlocked"), spring 136 is positioned to hold bolt 100 in its withdrawn position due to a force of spring 36 on turn-hub 130. When the bolt is extended, spring 136 causes contact between the spring and an extension 131 of turn bolt 130. Biasing lever 138 tends to urge turn-hub 130 into an unlocked position. The lock assumes one of two positions, and tends to remain in the assumed position by the action of spring 136. Specifically, the lock is urged by spring 136 to remain locked when locked and to remain unlocked when unlocked. In changing from one condition to the other, that is, in locking or unlocking the mechanism, the user is mechanically assisted by spring 136 as it assumes a stable locked or unlocked position. The user need not exert the entire force necessary to move the relatively massive parts, such as the dead bolt, into operative position, but need only move the extension of turn-hub 130 past a balanced position.

The user can select the level of security of the entry way lock as desired. By use of push buttons 76, 78, in combination with the action of hubs 72, 74, two different conditions are available. In a first condition, the user disables the key side lever handle by extending the rear of push button 76 into contact with extension 93 on the hub mounted to the key side spindle. In this condition, a user on the key side must use his key in order to withdraw latch bolt 80, to gain access, because his lever handle is immovable between stop 86 and push button 76. The key turns the lock cylinder which, through turn hub 132 and latch lever 134, forces latch bolt 80 backwards against the action of spring 81. It should be noted that since hub 72 is not rotated using the key, the user is not required to oppose the force of spring 88 which holds the lever handle in position, or the spring pressing against hub lever 82.

In a second mode, push button 76 is withdrawn to allow key side hub 72 to rotate freely. Push buttons 76, 78 are interactively connected such that depressing either will withdraw the other. This is accomplished by connection arm 77 which is loosely pivotally attached to push button 76, 78. A spring urges a ball bearing from a cavity in push button 78 against a central pivot pin on connection arm 77. The spring and ball bearing form a detent apparatus which secures push buttons 76, 78 in either of their two positions, regardless of reasonable vibrations and the like.

Whether or not push button 76 is activated, a user turning the non-key side lever handle automatically withdraws the dead bolt. Locking the dead bolt re-sets push buttons 76, 78 to the condition in which button 76 is depressed to disable movement of the key side lever handle. In this manner, both the dead bolt and the latch bolt secure the door when locked. When unlocked, the key side lever handle can be nonetheless disabled using push buttons 76, 78. This action is achieved by push buttons 76, 78 interacting with dual hubs 72, 74 and automatically reset by pivot arm 79 which transmits the motion of the dead bolt, and pivot arm 77 which transmits motion between buttons 76, 78.

The invention may be embodied in a number of ways, without departing from the essential attributes thereof. For example, the invention is fully applicable to a latch set incorporating a thumb piece apparatus on one side and a lever handle on the other side. Parts may vary. Accordingly, reference should be made to the appended claims rather than the foregoing specification as indicating the true scope of the invention.

What is claimed is:

1. A latch mechanism for a door, having concealed and protected mounting means, comprising:

a rotatable spindle shaft disposed in the door and extending beyond opposite surfaces of the door, rotation of the spindle shaft causing operation of the latch mechanism, the shaft having handles rigidly mounted on the ends thereof, at least one of the handles having a separate bushing mounted in a bore in the handle and extending therefrom to form a handle extension, the extension having an annular groove spaced from the handle;

first and second trim plates mounted on opposite surfaces of the door, the spindle shaft passing through openings in said first and second trim plates;

at least one post rigidly attaching the first and second trim plates to one another through the door, the post being endwise attached to a rear portion of both the first and second trim plates facing inwardly toward the door, exposed, outwardly-facing surfaces of the trim plates protecting the post from access;

a trim bushing removably connected to at least one of said trim plates, the trim bushing having a central bore, the handle extension extending through the bore in the trim bushing; and, a retaining ring fit in the annular groove of the handle extension, the retaining ring in the groove being dimensioned larger than the bore in the trim bushing, whereby said handle and spindle shaft are locked against movement along an axis defined by the spindle shaft, due to interaction of the retaining ring and the trim bushing.

2. The handle mount of claim 1, wherein said handle has at least a portion cantilevered with respect to the shaft, said handle mount further comprising a positioning means mounted on the shaft and having a spring for resisting rotation of the shaft from a predetermined rest position.

3. The handle mount of claim 1, wherein said trim plate is bored and said shaft is disposed in the bore, and further comprising at least one locking pin, transversely mountable in the shaft, said locking pin being larger than the bore in the trim plate, whereby axial movement of the shaft is prevented.

4. The mechanism of claim 1, wherein the post has an annular groove adjacent at least one end thereof, the post being attached to at least one of the first and second trim plates by a set screw threadably mounted in said at least one of the trim plates, the set screw being disposed transversely to an axis defined by the post, the set screw threadably disposed against the annular groove to rigidly attach the post to at least one of the first and second trim plates.

5. The handle mount of claim 4, wherein the at least one post has an annular groove adjacent both ends thereof, the post being attachable to both said trim plates by set screws transversely aligned and threadably disposable in the grooves.

6. The handle mount of claim 4, wherein the post is threaded at one end and grooved adjacent the opposite end, the threaded end being threadably attachable to a rear side of the trim plate on one side of the door, and attachable by the set screw and the other side of the door, whereby the attachment is protected by the trim plate on said one side of the door, and concealed due to the set screw on the other side of the door.

7. The handle mount of claim 1, further comprising a fusible link disposed between the handle and the shaft.

8. The handle mount of claims 1 or 9, further comprising means for positively positioning the handle at a predetermined orientation.

* * * * *